United States Patent [19]

Reiss

[11] 4,377,232

[45] Mar. 22, 1983

[54] VENETIAN BLIND COLOR SAMPLER PACKET

[75] Inventor: Harold Reiss, New York, N.Y.

[73] Assignee: Levolor Lorentzen, Inc., Lyndhurst, N.J.

[21] Appl. No.: 221,439

[22] Filed: Dec. 30, 1980

[51] Int. Cl.[3] ..... B65D 23/12

[52] U.S. Cl. ..... 206/44.11; 206/472; 33/168 R

[58] Field of Search ..... 206/44.11, 45.15, 450, 206/472, 449, 493; 33/168 R

[56] References Cited

U.S. PATENT DOCUMENTS

| | | | |
|---|---|---|---|
| 2,151,617 | 3/1939 | Richards | 33/168 R |
| 2,732,842 | 1/1956 | Loudon | 206/472 X |
| 3,338,409 | 8/1967 | Koellisch | 206/472 |

*Primary Examiner*—Steven M. Pollard

[57] ABSTRACT

A packet holding two stacks of actual pieces of painted Venetian blind slats mounted on posts to permit display of an assortment of slats arranged in color sequence.

7 Claims, 7 Drawing Figures

VENETIAN BLIND COLOR SAMPLER PACKET

BACKGROUND OF THE INVENTION

The present invention relates to a packet holding an assortment of actual pieces of Venetian blind slats arranged in color sequence for display purposes. It heretofore having been difficult to authentically reproduce the actual finish to be provided on a Venetian blind by printing colors with inks or by laminating foil on paper, the present invention displays actual pieces of Venetian blind slats which have been painted in the actual production finish, thereby to provide the viewer with an accurate sample of the color or finish which he may select.

SUMMARY OF INVENTION

The problem of showing the actual finish of colors painted on Venetian blind slats is overcome by the present invention which utilizes actual pieces of painted Venetian blind slats held within a convenient and novel packet by fastening means.

DETAILED DESCRIPTION

The invention may be more fully understood by the following description in relation to the drawings, in which.

Figure 5:
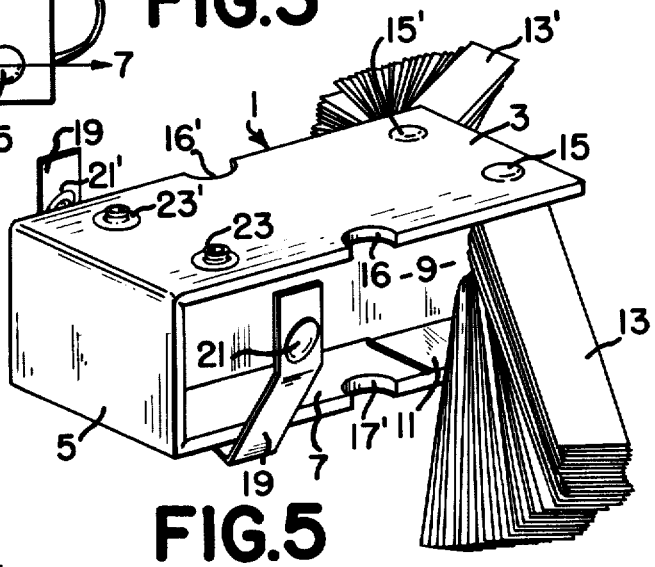
FIG. 5 is a perspective view of a Venetian blind color sampler packet in the opened position taken from the front, top and left end thereof.
Figure 6:
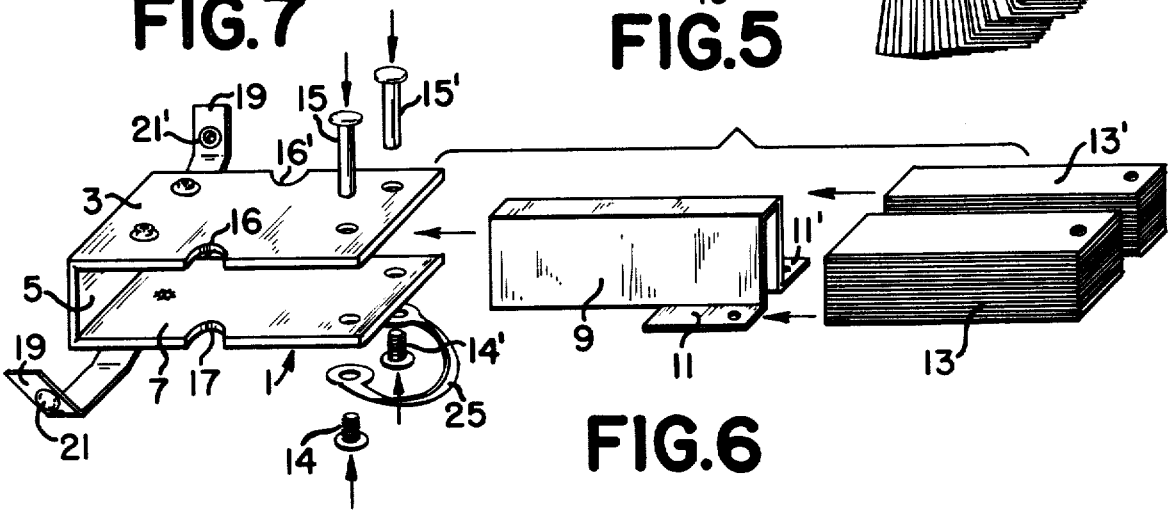
FIG. 6 is an exploded view in perspective of a Venetian blind color sampler packet, taken from the front, top and right end thereof; and, FIG. 7 is a broken sectional view taken along line 7—7 of FIG. 3.

The invention can best be described with reference to FIG. 5 which is a perspective view of a Venetian blind color sampler packet in the opened position. As will be seen particularly from FIG. 5 as well as from the exploded view of FIG. 6, the packet comprises an outer casing 1 having a top 3, left end 5, and bottom, 7 and open on the front, rear and right end thereof.

The casing 1 is divided into two longitudinal compartments by central walls formed by an inverted U-shaped channel 9, provided at the base thereof with wings 11 and 11' for attachment of channel 9 to the bottom 7 of casing 1 by means of posts 15 and 15'.

Figure 7:
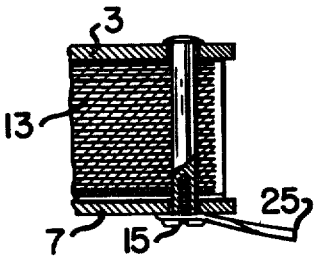

Colored Venetian blind sample slats 13 and 13' are securely pivotally mounted within the casing 1 by means of the fastening posts 15 and 15' passing through the casing and the sample Venetian blind slats. Hollow bolts 15 and 15' threaded internally to receive removable screws are particularly useful. See FIG. 7.

The slats 13 and 13' are so mounted within the casing 1 that they may readily be pivoted on their respective mountings outwardly of casing 1 by swiveling about the fastening means 15, so that any one or more of the samples may be observed.

To facilitate pivoting of the samples 13 and 13' for selection of desired colors, the top and bottom of casing 1 is provided with accurate cut-outs 16 and 16' and 17 and 17' to enable the fingers of a viewer to readily grasp the samples 13 and 13' and extend them a sufficient distance from casing 1 for examination.

In order to retain the Venetian blind sample slats 13 and 13' within the casing 1 when not in use, a strap 19 is affixed to the bottom of casing 1 and provided with fastening means, such as a snap fastener 21 and 21' for engagement with corresponding fastening means 23 and 23', respectively as shown. The ends of strap 19 preferably overlap one another to form a tab for detaching the snap fastener from the fastening means.

Figure 1:
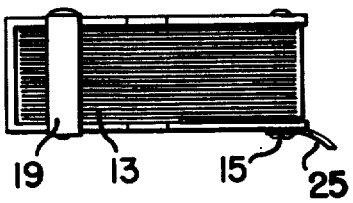
FIG. 1 is a front elevational view of a Venetian blind color sampler packet in the closed position, the rear elevation being a mirror image thereof.
Figure 2:
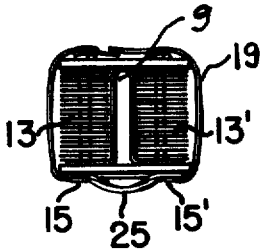
FIG. 2 is a right end elevational view thereof.
Figure 4:
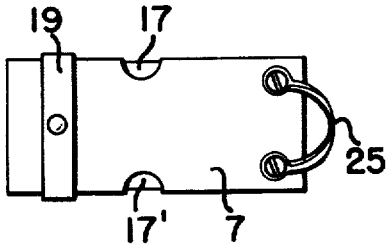
FIG. 4 is a bottom plan view thereof.
Figure 3:
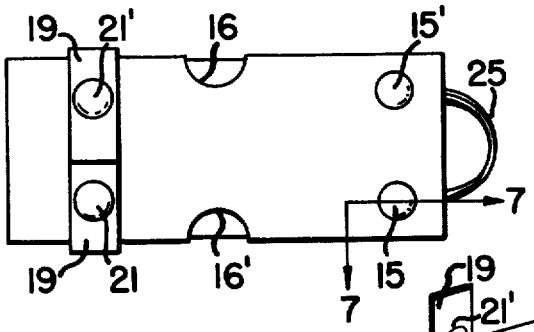
FIG. 3 is a top plan view thereof.

For convenience in carrying the sample packet, it may also be provided with a handle in the form of a loop 25 affixed to casing 1, as shown particularly in FIGS. 1, 3 and 4.

It will be noted that this invention is very simple and economical to manufacture, owing to its ready accessibility via the sliding of the inverted U-shaped channel 9 into the casing 1 and thereon inserting the slats 13 and 13' which are mounted by means of fastening posts passing through the slats and secured by only two removable screws 14 and 14'. This readily facilitates the insertion and removal of slats to add new color samples and to remove discontinued colors from the packet.

Resort may be had to such modifications and equivalents as fall within the spirit of the invention and the scope of the appended claims.

What is claimed is:

1. A packet for displaying an assortment of Venetian blind sample slats in different colors comprising a casing having top, bottom and end portions, the casing being open on two sides and one end, two sets of a plurality of Venetian blind sample slats pivotally mounted completely within said casing adjacent said open end by fastening means connecting said sample slats within said top and bottom portions, each set being separated from one another by a central partition in the casing, whereby said sample slats may be extended from said casing for individual viewing purposes.

2. A packet according to claim 1, wherein said partition comprises a U-shaped channel secured to said casing.

3. A packet according to claim 2, wherein said U-shaped channel is provided with laterally extending wings for securing said channel to said casing.

4. A packet according to claim 1, wherein said casing is provided with a strap and fastening means to retain said sample slats within said casing when not in use.

5. A packet according to claim 1, wherein carrying means are connected to said casing to facilitate carrying of said packet.

6. A packet according to claim 1, wherein the top and bottom of said casing are provided with accurate cut-outs at the edges thereof whereby to facilitate grasping the sample slats with the fingers.

7. A packet according to claim 1, wherein said fastening means comprises at least one post and a detachable screw whereby to facilitate ready removal from and addition to the packet of the sample slats.

* * * * *